United States Patent [19]

Wadsworth

[11] Patent Number: 4,529,094

[45] Date of Patent: Jul. 16, 1985

[54] ARTICULATION FOR TOWER CRANE BOOM THAT HAS A PARKING POSITION

[75] Inventor: Charles L. Wadsworth, Escanaba, Mich.

[73] Assignee: Harnischfeger Corporation, Milwaukee, Wis.

[21] Appl. No.: 525,170

[22] Filed: Aug. 22, 1983

[51] Int. Cl.[3] ..... B66C 23/06; B66C 23/26; B66C 23/82

[52] U.S. Cl. ..... 212/255; 212/182; 212/232; 212/237; 212/260

[58] Field of Search ..... 212/175, 177, 181-188, 212/199, 211, 227, 231-232, 237, 255, 260

[56] References Cited

U.S. PATENT DOCUMENTS

| | | | |
|---|---|---|---|
| 3,794,184 | 2/1974 | Higgins | 212/183 |
| 3,939,988 | 2/1976 | Wellman | 212/184 |

FOREIGN PATENT DOCUMENTS

| | | | |
|---|---|---|---|
| 1100248 | 2/1961 | Fed. Rep. of Germany | 212/185 |
| 219775 | 10/1968 | U.S.S.R. | 212/182 |
| 228243 | 3/1969 | U.S.S.R. | 212/183 |
| 239522 | 5/1970 | U.S.S.R. | 212/182 |

*Primary Examiner*—Galen L. Barefoot
*Assistant Examiner*—R. Johnson
*Attorney, Agent, or Firm*—James E. Nilles

[57] ABSTRACT

The inner end of a tower crane boom is connected to the top of its tower by two lugs fixed on the tower, each having an upwardly opening slot, and two trunnions fixed on the inner end portion of the boom, one for each lug, each rotatably seatable in the rounded bottom of the slot in its lug. The slot bottom in one lug defines a first fixed axis, midway between the front and rear sides of the tower, about which the boom swings in its range of working positions; that in the other lug defines a second fixed axis, near the front side of the tower, about which the boom swings to and from an inoperative position wherein it extends along the front side of the tower. The distance between the trunnion axes equals the distance between the fixed axes. Links confine the boom against moving to a position in which neither trunnion is seated in the slot in its lug. Each link has a pivot connection with the tower at a fixed axis defined by one lug and a pivot connection with the boom at the axis defined by the trunnion for the other lug. Preferably, lugs, trunnions and links are duplicated at opposite sides of a vertical plane of symmetry.

4 Claims, 7 Drawing Figures

ARTICULATION FOR TOWER CRANE BOOM THAT HAS A PARKING POSITION

FIELD OF THE INVENTION

This invention relates to tower cranes having a substantially upright tower and having a boom connected with the top of the tower to swing up and down through a range of forwardly projecting working positions; and the invention is more particularly concerned with articulation means for a tower crane whereby the boom is so connected with the tower as to provide two horizontally spaced apart axes about which the boom can swing, one of those axes being midway between the front and back sides of the tower and being the axis about which the boom swings through its range of working positions, and the other being near the front side of the tower and being an axis about which the boom swings to and from an inoperative parking position in which it extends down along the front side of the tower.

BACKGROUND OF THE PRIOR ART

The upright boom of a large tower crane can extend to a height of well over 150 ft. (45 m.), and the boom that projects forward from the tower may have a length which is only slightly less than the height of the tower. When the crane is working, the boom is swung up and down through an operating range that can carry it from about 15° to about 75° above the horizontal, for moving a hoisted load toward and from the base of the crane. Because of the height of the tower and the length of the boom, it is desirable to enable the boom to be swung to an inoperative parking position in which the boom extends down alongside the tower. In that position of the boom, high winds exert less force and leverage against it, so that the crane is less likely to be tipped over by a high wind. The boom is also brought to this inoperative position when the tower is to be lowered, the tower then being swung forwardly down to a horizontal position in which the boom underlies it.

For the boom to be brought to its inoperative position, it must swing down from its lowermost working position about an axis that is at least a short distance in front of the front side of the tower. In its range of working positions, however, the boom should preferably swing about an axis that is centered on the top of the tower—that is, midway between the front and rear sides of the tower—so that the forces that the boom exerts upon its pivot axis do not impose bending moments upon the tower.

In most prior tower cranes, the axis about which the boom swung through its range of working positions was also the axis about which it swung to and from its inoperative position, and that axis was located at or slightly in front of the front side of the tower. To support the bending loads that are imposed upon the tower with the boom axis in this off-center location, the tower must be built with substantially greater strength than would be needed if the boom pivot axis were centered over the tower in the working range of the boom, thus increasing the cost of the tower and raising the center of gravity of the crane as a whole.

Some difficult problems are involved in shifting the axis about which the boom swings, because all control of the boom must be exerted from near the bottom of the tower. For safety, it should not be possible to lower the boom below the lower part of its working range unless its swinging axis has been shifted to the forward position, and the boom should not be allowed to swing in its working range until its swinging axis has been shifted back to where it is centered over the tower. Obviously, any expedient for shifting the boom axis must be so sturdy and simple as to be extremely reliable, but should nevertheless be inexpensive and relatively light in weight.

SUMMARY OF THE INVENTION

The general object of the present invention is to provide an articulation between the top of the tower of a tower crane and a boom which projects forwardly from the tower when in a range of working positions, said articulation defining two axes about which the boom can swing, one of them being centered over the tower, midway between its front and rear sides and being the axis about which the boom swings in its range of working positions, the other being adjacent to the front side of the tower and being an axis about which the boom swings to and from an inoperative position in which it extends down along the front side of the tower, said articulation being so arranged that there is an automatic transfer from one to the other of these axes as the boom swings through a transitional position that is between the range of its working positions and a lower range of nonoperating positions in which it swings to and from its inoperative position.

It is also a general object of this invention to provide an articulation of the character just described that is extremely sturdy and reliable but nevertheless light in weight, low in cost, automatic in performing its function of shifting the axis about which the boom swings, and compatible with latching means whereby the boom is releasably confined in its inoperative position.

A more specific object of the invention is to provide an articulation of the character described that comprises tower joint elements that are fixed on the top of the tower and define said two axes about which the boom can swing, and cooperating boom joint elements that are fixed on the boom and are engageable with and disengageable from respective tower joint elements, engagement of each boom joint element with its cooperating tower joint element providing for swinging of the boom about the axis defined by the engaged tower joint element.

A further specific object of the invention is to provide an articulation comprising tower joint elements and cooperating boom joint elements as just described, and further comprising simple and sturdy link means connected between the tower and the boom and whereby the boom is confined against movement to a position in which neither of the boom joint elements is engaged with a tower joint element.

In general, these and other objects of the invention that will appear as the description proceeds are achieved in the articulation means of this invention, which provides a connection between the top of a substantially upright tower that has front and rear sides and an inner end portion of a boom that has an outer end from which a hoisting cable depends. The articulation means enables the boom to swing through a range of forwardly projecting working positions about a horizontal first fixed axis that is intermediate the front and rear sides of the tower and to swing to and from an inoperative position, extending downwardly along the front side of the tower, about a second fixed axis that is spaced a distance forwardly from the first fixed axis. The articulation means of this invention is characterized by two pairs of engageable and disengageable joint elements, each pair comprising a tower joint element fixed on the top of the tower and a paired boom joint element fixed on said inner end portion of the boom. The several joint elements are so disposed that said tower joint elements define the respective fixed axes and each boom joint element defines a boom axis which coincides with the fixed axis defined by its paired tower joint element when the boom joint element is engaged therewith, one of said boom axes extending transversely to the boom across its inner end and the other boom axis being parallel thereto and spaced outwardly along the boom at said distance therefrom. One joint element of each pair comprises a trunnion, and the other joint element of each pair comprises a bearing member having a slot with a closed end that defines a rotatable seat for the trunnion when the paired joint elements are engaged and with an opposite end that opens vertically away from said closed end to provide for engagement and disengagement of the paired joint elements by substantially vertical motion of the boom joint element. Elongated link means prevent the boom from moving to a position in which neither of said pairs of joint elements is engaged, said link means having at one end thereof a pivotal connection with the tower that is rotatable about the fixed axis defined by the tower joint element of one of said pairs and having at the other end thereof a pivotal connection with the boom that is rotatable about the boom axis defined by the boom joint element of the other of said pairs.

Preferably there are two link means, one for each tower joint element, each having at one of its ends a pivotal connection with the tower that is rotatable about the fixed axis defined by its tower joint element and each having at its other end a pivotal connection with the boom that is rotatable about the boom axis defined by the boom joint element paired with the other tower joint element. The two link means are laterally spaced apart, and preferably each comprises two links that are spaced equal distances to opposite sides of the vertical plane of symmetry of the boom.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
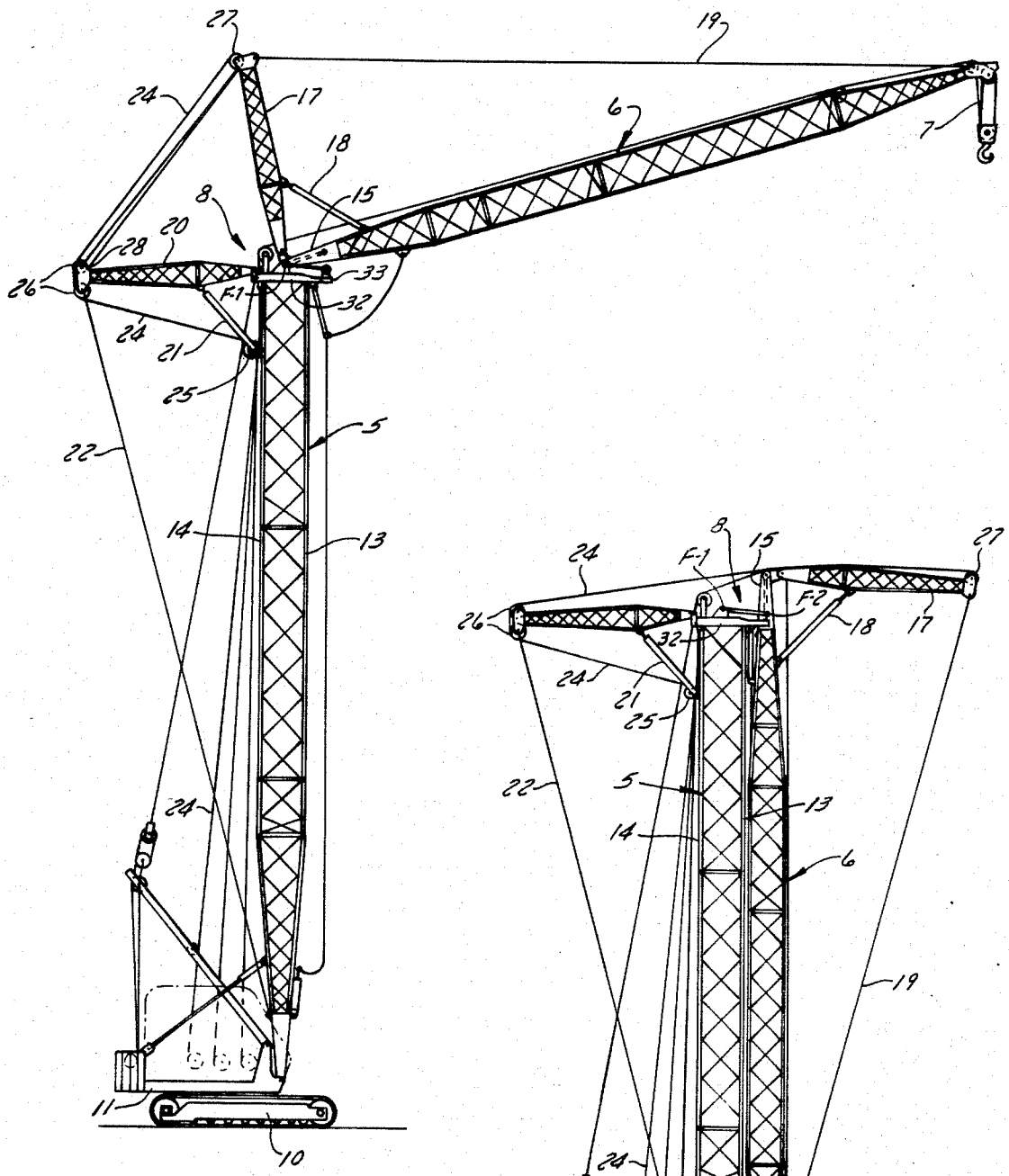
FIG. 1. is view in side elevation of a tower crane embodying the principles of this invention with the boom in working position.

A tower crane that embodies the principles of this invention comprises a high upright tower 5 and a boom 6 that has an outer end from which a load hoisting cable 7 depends and an inner end portion that is connected to the top of the tower 5 by means of articulation means 8 of this invention. The crane in this case has a base 10 equipped with crawler treads and comprises the usual platform 11 which is mounted on the base for rotation relative to it about a vertical sluing axis. The platform 11 in turn supports the tower 5 as well as such conventional elements as an operator's cab, engine and winches.

When the crane is in operation, the boom 6 projects forward from the top of the tower 5, as shown in FIG. 1, and is swingable relative to the tower in a vertical plane, through a range of working positions in which the longitudinal centerline of the boom makes upward angles to the horizontal of between about 15° and 75°. Such vertical swinging of the boom 6 enables a hoisted load to be moved towards and from the base 10 of the machine, while sluing motion provides for moving the hoisted load to the left and right. Vertical swinging of the boom 6 in its range of working positions takes place about a first fixed axis F-1, which is defined by a first pair of engageable and disengageable joint elements as explained hereinafter. That first fixed axis F-1 is located midway between the front side 13 and the rear side 14 of the tower, so that the load forces imposed upon the top of the tower through that axis are centered relative to the tower and therefore impose no bending moments upon it.

As the boom is allowed to swing below its range of working positions, it passes through a transition position in which it extends substantially horizontally and in which a second pair of cooperating joint elements (described hereinafter) are automatically engaged to define a second fixed axis F-2, which is spaced a small distance forward of the front side 13 of the tower and which is parallel to the first axis F-1. With continued downward swinging of the boom, the cooperating joint elements of the first pair are disengaged and the boom swings about the second axis F-2 until it reaches the inoperative or parking position shown in FIG. 2, wherein it extends downward along the front side of the boom. In swinging upward from the inoperative position, the boom first swings about the second or front axis F-2 until it reaches the above mentioned transition position, and then swings about the first axis F-1.

The articulation means 8 of this invention, which comprises the cooperating joint elements that define these alternatively employed axes, is described in detail hereinafter. At this point, however, certain other features should be noted in a crane that comprises the articulation means 8 of this invention.

Figure 2:
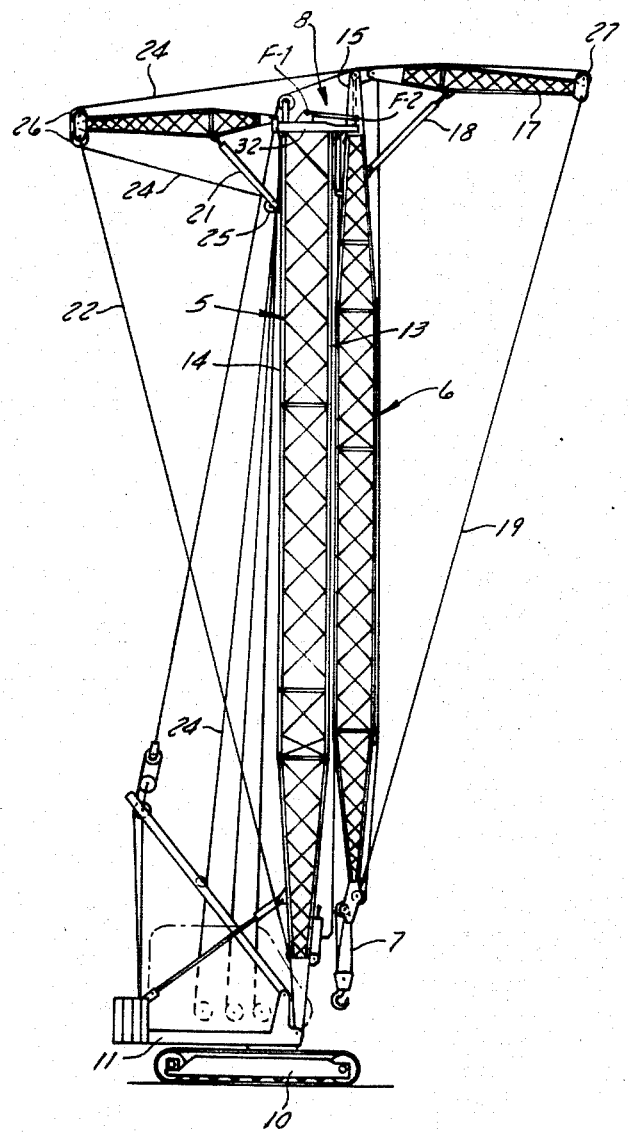
FIG. 2 is a view similar to FIG. 1 but showing the boom in its inoperative position.
Figure 3:
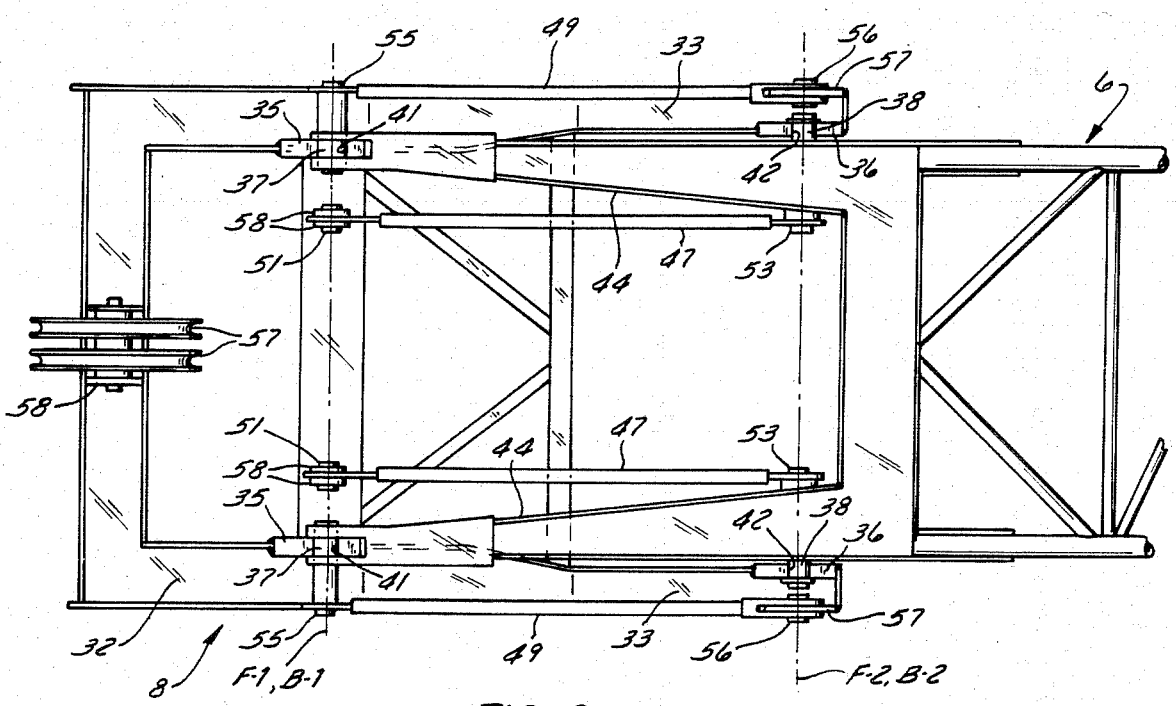
FIG. 3 is a top plan view of the articulation means of this invention.
Figure 7:
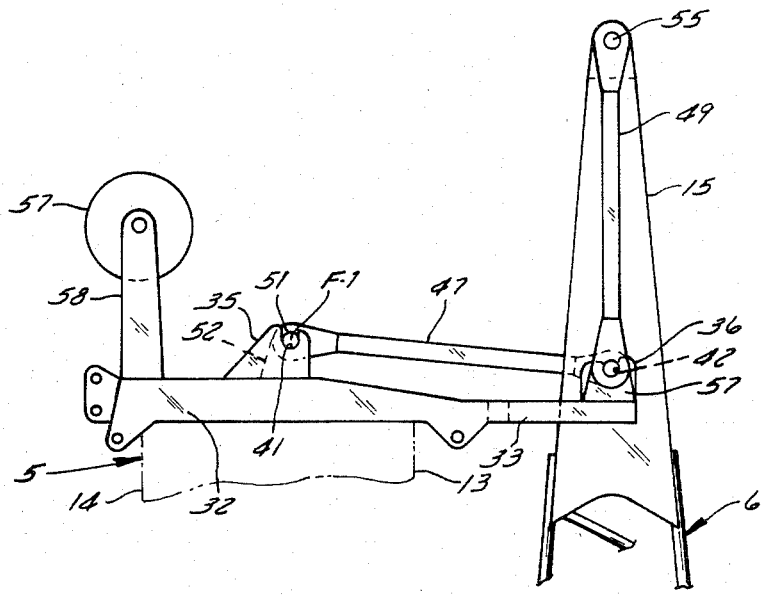

The first axis F-1, which is centered on the tower 5 and about which the boom 6 swings in its range of working positions, extends across the inner end of the boom and is of course horizontal and transverse to the length of the boom. However, the second or forward axis F-2 is spaced outwardly along the boom from its inner end, and therefore when the boom is in its inoperative position a short inner end portion 15 of it, substantially equal in length to the distance between the fixed axes, projects above the top of the tower, as shown in FIGS. 2 and 7.

For actuating the boom 6 to swing between its inoperative and its working positions, and through its range of working positions, a strut 17 is fixed on the inner end of the boom, extending substantially at right angles to the boom to project upward when the boom is in its working positions and to project forward when the boom is in its inoperative position. A rigid diagonal brace 18 is connected between the strut 17 and the boom 6, and a pendant or tension cable 19 is connected between the tip of the strut 17 and the outer end of the boom. In like manner there is a strut 20 that projects rearward from the top of the tower 5, supported by a rigid brace 21 that extends diagonally down to the tower and having a pendant 22 connected between its tip and the bottom portion of the tower. A cable 24 for actuating the boom 6 in its vertical swinging extends up from one of the winches, around an idler sheave 25 that is at the rear side of the tower and a distance below its top, thence around sheaves 26 at the tip of the horizontal strut 20, through sheaves 27 on the tip of the boom-carried strut 17, and back to a fixed connection 28 at the tip of the horizontal strut 20. It will be apparent that when this cable 24 is wound in, the tip of the strut 17 is drawn towards the tip of the horizontal strut 20, raising the outer end of the boom; whereas unwinding the cable 24 allows the outer end of the boom to descend. Because the strut 17 is mounted on the very inner end of the boom, which is above the level of the horizontal strut 20 when the boom is in its inoperative position (see FIG. 2) the two struts 17 and 20 can cooperate with the cable 24 for raising the boom from its inoperative position. Note that, for simplicity, the strut 17 is not shown in FIGS. 3–7.

The base portion of the tower 5 is pivoted to the platform 11 so that the tower can be swung down forwardly from its erected position shown in the drawings to a horizontal position in which the boom 6 underlies it. Before the tower is swung down, the boom, in its inoperative position, is releasably latched to the tower, known latching means (not shown) being arranged to effect such latching automatically when the tower reaches its inoperative position. The latching means is of course manually released after the tower is erected and when the boom is to be swung up to its range of working positions. The means for swinging the tower between its erected and its horizontal positions is also known, comprising a gantry 30.

The articulation means 8 of this invention comprises a tower cap 32 that is fixed to the top of the tower and has a pair of legs 33 that project forward beyond the front side 13 of the tower. Fixed to the top of the tower cap are rear and front tower joint elements 35, 36 which respectively define the two fixed axes F-1 and F-2 about which the boom swings and which cooperate with respective boom joint elements 37 and 38 that are fixed on the inner end portion of the boom. In this case the boom joint elements 37, 38 comprise trunnions and the tower joint elements 35, 36 comprise upwardly projecting lugs in which there are upwardly opening slots 41, 42 wherein the trunnions 37, 38 are respectively receivable; but it will be obvious that this relationship could be reversed in that the tower joint elements could comprise fixed trunnions and the boom joint elements could comprise lugs with downwardly opening slots.

As shown and preferred, each of the joint elements comprises duplicate members spaced equal distances to opposite sides of a vertical plane of symmetry that contains the longitudinal centerlines of the tower and the boom. Thus the rear tower joint element 35 comprises a pair of upwardly projecting lugs on the tower cap 32, one near each lateral side of the tower, and the front tower joint element 36 likewise comprises a pair of upwardly projecting lugs, one fixed on the front end of each of the leg portions 33 of the tower cap. The upwardly opening slot 41, 42 in every lug 35, 36 has a semicircular bottom end in which a trunnion is closely rotatably receivable, the arcs of the bottom ends of these slots having their centers on the respective fixed axes F-1, F-2.

Figure 4:
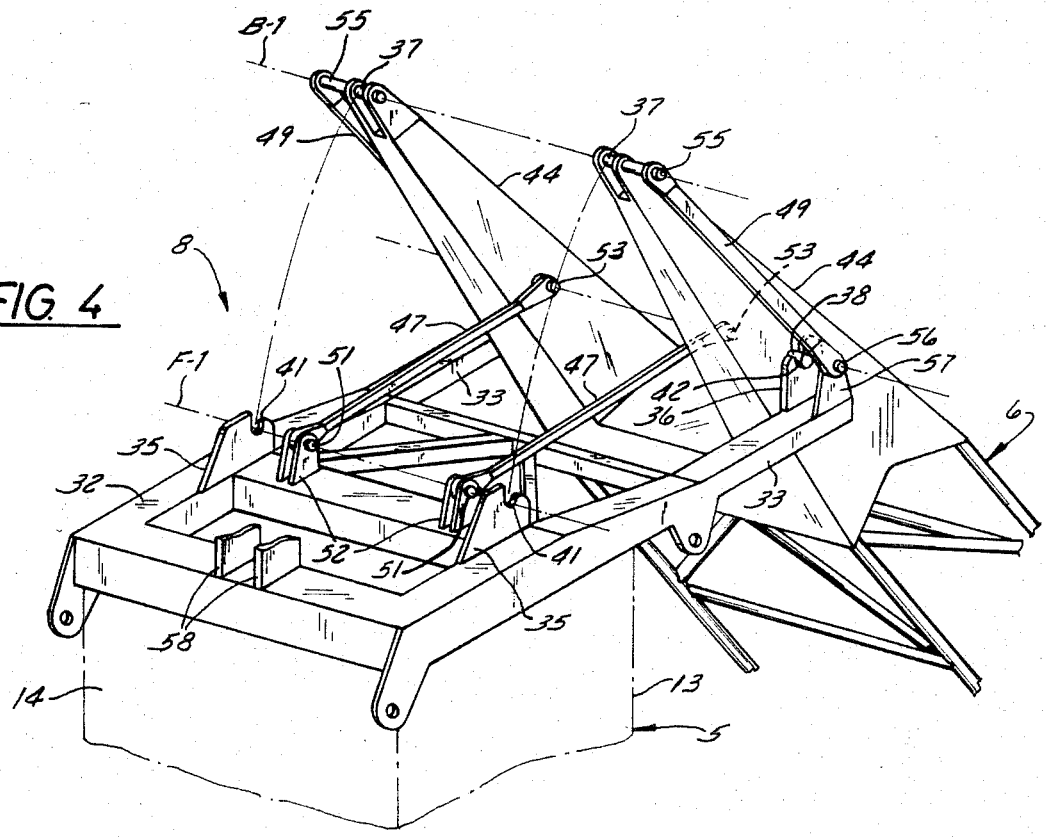
FIG. 4 is a perspective view of the articulation means as seen from above and to the rear of the top of the tower.
Figure 5:
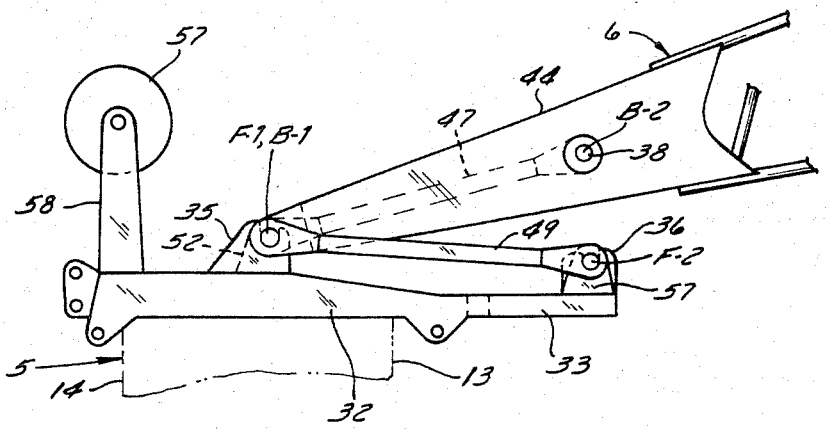
FIGS. 5, 6 and 7 are fragmentary views in side elevation showing successive conditions of the articulation means as the boom swings down from the lower part of its range of working positions to its inoperative position.
Figure 6:
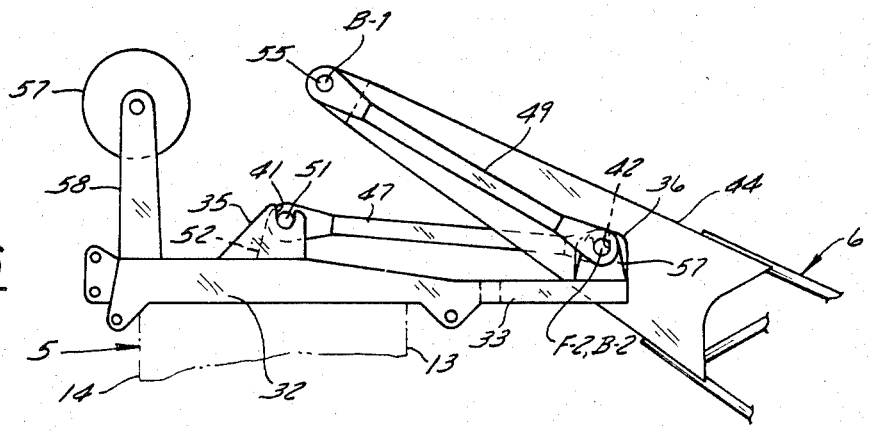

Each boom joint element 37, 38 comprises two coaxial trunnions that are spaced to opposite sides of the vertical plane of symmetry by a distance such as to be receivable in the slots of the lugs 35, 36 that comprise the cooperating tower joint element. Specifically, as best seen in FIG. 4, the inner end portion of the boom is U-shaped to have a pair of legs 44, and at the extreme inner end of the boom each leg 44 is in turn bifurcated and one of the coaxial trunnions that comprise the rear boom joint element 37 bridges across the bifurcations. As each of these trunnions 37 is received in a slot 41 of the rear tower joint element 35, the bifurcations of the boom leg overlie opposite faces of the lug that contains the slot 41, confining the boom against movement in directions along the boom axes. It will be seen that the trunnions that comprise the rear boom joint element 37 define a first boom axis B-1 that coincides with the first fixed axis F-1 when those trunnions are received in the slots 41, that is, when the boom joint element 37 is engaged with its cooperating tower joint element 35.

The coaxial trunnions that comprise the front boom joint element 38 are anchored in the legs 44 of the U-shaped inner end portion of the boom and project laterally outwardly from those legs. The legs 44 thus have their laterally outer faces close to the inner faces of the lugs that comprise the front tower joint element 36 when the front joint elements 36, 38 are engaged, thereby confining the boom against movement parallel to the fixed axes F-1, F-2. It will be seen that the coaxial trunnions that comprise the front boom joint element 38 define a second or front boom axis B-2 that is parallel to the first boom axis B-1 and is spaced from it by a distance equal to the distance between the fixed axes F-1 and F-2, and the front boom axis B-2 coincides with the front fixed axis F-2 when the front joint elements 36, 38 are engaged.

It will be evident that when the boom is in its range of working positions the rear joint elements 35, 37 are engaged and the boom swings about the coinciding axes F-1 and B-1; and when the boom is swinging to and from its inoperative position the front joint elements 36, 38 are engaged and the boom swings about the coinciding front axes F-2 and B-2. Because the boom axes B-1, B-2 are spaced apart by the same distance as the fixed axes F-1, F-2, the boom has a transition position, just below its range of working positions, in which both boom joint elements 37, 38 are fully engaged with their respectively cooperating tower joint elements 35, 36; and the boom passes through that transition position in the course of transferring its swinging motion from one to the other of the fixed axes F-1, F-2.

It will be evident that the boom must be constrained against movement to a position in which neither pair of cooperating joint elements 35, 37 or 36, 38 is engaged. To that end, two link means 47 and 49 are connected between the tower cap and the boom, each link means in this case comprising a pair of elongated and parallel links that are spaced equal distances to opposite sides of the plane of symmetry. Each of the link means 47, 49 has at one end thereof a pivotal connection to the tower that is rotatable about the fixed axis F-1, F-2 defined by the tower joint element 35, 36 of one of the cooperating pairs of joint elements, and has at its other end a connection to the boom that is rotatable about the boom axis B-2, B-1 defined by the boom joint element 38, 37 of the other cooperating pair of joint elements.

As here shown, one link means 47 comprises a pair of individual links that lie inwardly adjacent to the legs 44 of the U-shaped inner end portion of the boom. The rear end of each of those two links pivots about a short trunnion 51 carried by laterally spaced upwardly projecting lugs 52 that are fixed on the tower cap, the axes of said trunnions 51 coinciding with the rear fixed axis F-1 defined by the rear tower joint element 37. The front end of each of those individual links pivots about a trunnion 53 that projects inwardly from a leg 44 of the U-shaped inner boom portion, which trunnion 53 is coaxial with the front boom axis B-2.

The other link means 49, as here shown, comprises a pair of individual links that lie outwardly adjacent to the legs 44 of the U-shaped inner end portion of the boom. The rear end of each of the last-mentioned two links pivots about a trunnion 55 on the rear boom axis B-1, and each such trunnion 55 can comprise an extension of one of the trunnions comprising the rear boom joint element 37, which can project laterally outwardly beyond the bifurcations that carry it to provide for the link connection. At its front end each of the last mentioned individual links has a pivotal connection with a short trunnion 56 that is carried by a small lug 57 fixed on a forwardly projecting leg portion of the tower cap, said trunnion 56 of course being coaxial with the front fixed axis F-2.

It will be evident that the link means 47, 49 not only control the boom in its vertical movements, constraining it to swing about one or the other of the fixed axes F-1, F-2, but also impart lateral stability to the boom, confining it against side-to-side swinging and translatory movement relative to the tower.

To carry the hoisting cable 7 from behind the tower around to the outer end of the boom 6 and over the articulation means 8, there are idler sheaves 59 mounted on top of a strut 58 that projects up from the tower cap 32 near the rear side of the tower.

From the foregoing description taken with the accompanying drawings it will be apparent that this invention provides simple, sturdy and inexpensive articulation means whereby the boom of a tower crane is so connected with the top of its tower that the boom swings about an axis which is centered between the front and back sides of the tower when the boom is in its range of working positions, and swings about an axis that is near the front side of the tower as it is brought to and from an inoperative position in which it extends down along the front side of the tower, transfer from one to the other of these axes being effected automatically as the boom passes through a transition position.

What is claimed as the invention is:

1. A crane comprising an upright tower (5) that has a top and front (13) and rear (14) sides, a boom (6) that has an outer end from which a load hoisting cable (7) can depend and an inner end, and articulation means (8) providing a connection between said top of said tower (5) and said inner end of said boom (6) whereby said boom (6) can swing through a range of upwardly projecting positions above horizontal about a horizontal rear fixed axis (F-1) that is located at said top of said tower (5) between said front (13) and rear (14) sides of said tower (5) and whereby said boom (6) can swing through a range of downwardly projecting positions below horizontal about a horizontal forward fixed axis (F-2) that is located at said top of said tower (5) and spaced forwardly from and parallel to said rear fixed axis (F-1), said downwardly projecting positions including an inoperative position wherein said boom (6). extends substantially vertically downward along said front side (13) of said tower (5), said articulation means (8) comprising:

A. at least one rear pair of engageable and disengageable joint elements (35,37),
  (1) said rear pair comprising
    (a) a rear tower joint element (35) fixed on the top of said tower (5) on said rear fixed axis (F-1) and
    (b) an associated rear boom joint element (37) fixed on said inner end of said boom (6), B. at least one forward pair of engageable and disengageable joint elements (36,38),
  (1) said forward pair comprising
    (a) a forward tower joint element (36) fixed on the top of said tower (5) on said forward fixed axis (F-2) and
    (b) an associated forward boom joint element (38) fixed on said boom (6) at a location outwardly of said rear boom joint element (37) at a distance equal to that between said rear and forward axes (F-l,F-2),
  (2I) one joint element (37,38) of said pair comprising a trunnion and
  (3) the other joint element (35,36) of each forward pair comprising a slot (41,42)
    (a) with a closed end that defines a seat on which the trunnion of an associated element can rotate when engaged therewith and
    (b) with an opposite open end to enable engagement and disengagement of the trunnion of an associated element in the ocurse of substantially vertical relative motion of the boom joint elements;
  (4) said boom (6) being swingable through said downwardly projecting positons about said forward fixed (F-2) when said forward pair of joint elements (36,38) are engaged and said rear pair of joint elements (35,37) are disengaged;
  (5) said boom (6) being swingable through said upwardly projecting positions about said rear fixed axis (F-1) when said rear pair or joint elements (35,37) are engaged and said forward pair of joint elements (36,38) are disengaged;

C. at least one elongated first link (47) having
  (1) one end pivotally conntected (51,52) to the top of said tower (5) on said rear fixed axis (f-1) and
  (2) an opposte end pivotally connected (53) to said boom (6) on the same axis (B-2) as said forward boom join element (38);

D. at least one elongated second link (49) having
  (1) one end fixedly connected (55) to said boom (6) the same axis (B-1) as said rear boom joint element (37) and
  (2) an opposite end pivotally connected (56) to the top of said tower (5) on said forward fixed axis (F-2);
  (3) said first and second links (47,49) being operable to prevent said boom (6) from moving relative to said tower (5) to a position in which neither of said rear or forward pairs of joint elements is engaged; and E. means (17, 18, 19, 24) connected to said boom (6) to effect swinging movement of said boom (6) about either one of said rear fixed axis (F-1) or said forward fixed axis (F-2).

2. A crane according to claim 1 wherein each of said tower joint elements (35,36) comprises a slot (41,42) and wherein each of said boom joint elements (37,38) comprises a trunnion.

3. A crane according to claim 1 including two of said rear pairs of joint elements (35,37 and 35,37) laterally spaced apart from each other and including two of said forward pairs of joint elements (36,38 and 36,38) laterally spaced apart from each other.

4. A crane according to claim 3 wherein each tower joint element (35,36) comprises a slot (41,42) and wherein each boom joint element (37,38) comprises a trunnion.

* * * * *